United States Patent [19]

Nagumo

[11] 3,977,383

[45] Aug. 31, 1976

[54] ENGINE INTAKE MANIFOLD

[75] Inventor: Shinichi Nagumo, Yokohama, Japan

[73] Assignee: Nissan Motor Co., Ltd., Yokohama, Japan

[22] Filed: Nov. 26, 1974

[21] Appl. No.: 527,498

[30] Foreign Application Priority Data

Nov. 30, 1973 Japan ..... 48-134597

[52] U.S. Cl. ..... 123/141; 123/122 AC; 48/180 M; 48/180 R

[51] Int. Cl.[2] ..... F02M 29/00

[58] Field of Search ..... 123/141, 123 AC, 119 E; 48/180 M, 180 R; 261/18 A, DIG. 55, DIG. 21

[56] References Cited

UNITED STATES PATENTS

| | | | |
|---|---|---|---|
| 862,856 | 8/1907 | Tygard | 123/141 |
| 1,939,302 | 12/1933 | Heaney | 48/180 |
| 2,414,494 | 1/1947 | Vang | 123/119 E |
| 2,732,835 | 1/1956 | Hundt | 123/119 E |

*Primary Examiner*—Charles J. Myhre
*Assistant Examiner*—R. H. Lazarus

[57] ABSTRACT

An engine intake manifold having a diaphragm opposed to an inlet of the riser of the manifold and means for applying a high frequency alternate electric voltage across the both sides of the diaphragm to induce mechanical vibration of the diaphragm.

1 Claim, 1 Drawing Figure

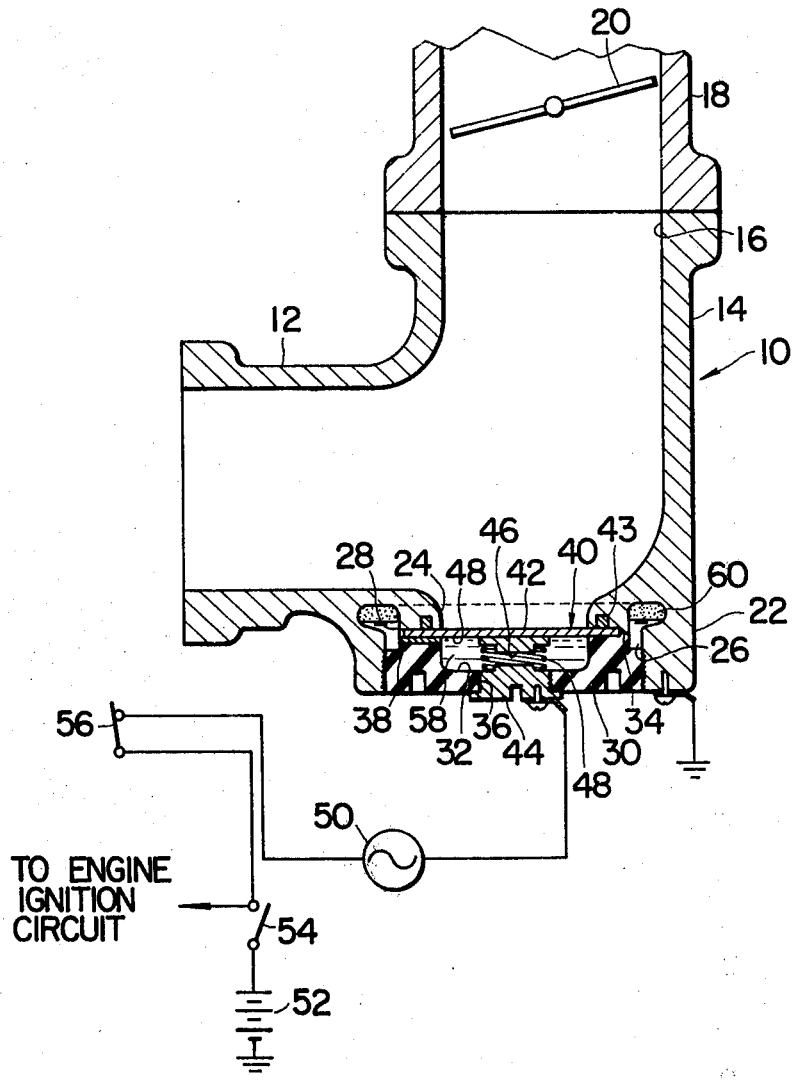
20
18
16
14
12
10
46
43
28
24
48
42
40
60
22
26
56
38
58
36
34
32
44
30
48
50
TO ENGINE
IGNITION
CIRCUIT
54
52

ENGINE INTAKE MANIFOLD

The present invention relates to engine intake manifold and more particularly to a device for vaporizing unvaporized fuel within the intake manifolds.

In automobile engines in particular, it is common practice to provide bosses on the intake and exhaust manifolds for the transfer of heat from the exhaust manifold to the intake manifold to facilitate vaporization, particularly during engine starting. For this purpose, the exhaust manifold is frequently provided with a deflecting valve which is thermostatically controlled, the valve initially standing at an angle to throw the exhaust gases against the heat exchange boss, and having thermostatic spring for adjusting the valve into parallelism with exhaust gas flow as the engine warms up. The conventional construction described above has the shortcoming that the deflecting valve causes exhaust gas pressure upstream of the valve to increase when the valve is at an angle, and mechanism for thermostatic control of the valve is complicated, in construction and installation. To heat the boss on the intake manifold it has been proposed to use engine coolant, however the engine coolant is inadequate for vaporization of all fuel deposited on the boss where the amount of the deposited fuel is relatively great during engine starting under cold weather.

The present invention seeks to vaporize unvaporized fuel by imparting thereto a high frequency mechanical vibration, so that a heat source and a deflecting valve which are necessary in the prior art are eliminated. According to the present invention an engine intake manifold is provided with a pulsating diaphragm in the bottom wall opposed to an inlet of a riser of the manifold, the pulsating diaphragm being preferably made of a piezoelectric material, and there is provided means for applying a high frequency alternate electric voltage across the both sides of the diaphragm, particularly during cold engine starting.

It is known that barium titanate resonates with alternate electric voltage of Mega-cycle order and ferrite with alternate electric voltage of Kilo-cycle order, both being piezoelectric materials. It has been found that barium titanate or ferrite capable of exciting mechanical vibration ranging from Kilo-cycle order to Mega-cycle order is appropriate as a material of the pulsating diaphragm.

Preferably a damper chamber is disposed in the bottom to apply load on the diaphragm so as to prevent breakage of the diaphragm due to excessive mechanical vibration.

It is therefore an object of the present invention to provide an engine intake manifold, in which unvaporized fuel droplets are atomized to fine particles for ease of vaporization.

It is another object of the present invention to provide an improved engine intake manifold construction including the features as aforementioned.

The above objects, features and advantages of the present invention will become more apparent from the following description, read in conjunction with the accompanying drawing, in which:-

A single FIGURE is a partial sectional view of an engine intake manifold equipped with a device embodying the present invention.

Referring to the accompanying drawing there is shown an engine intake manifold according to a preferred embodiment of the present invention, the manifold being generally designated at 10. The intake manifold 10 has in a conventional manner a plurality of branches, one being shown and designated at 12, and an upwardly extending riser 14. The riser 14 is provided with an inlet 16 for connection to a carburetor 18 provided with a throttle 20, in conventional manner.

Bottom wall 22 of the riser 14 is made of an electrically conductive material and has a circular opening 24 and an enlarged bore 26 aligned with the opening 24. The opening 24 and the enlarged bore 26 define therebetween a shoulder 28 facing outwardly from the manifold 10 and the enlarged bore is tapped. A threaded plug 30 made of an electrically insulating material is screwed into the enlarged bore 26. The plug 30 has a depression 32 to define an annular bank 34 and a hole 36 which is tapped. The bank 34 has at least one radial passage 38. A diaphragm 40 made of piezoelectric material, preferably made of barium titanate or ferrite capable to excite mechanical vibration ranging from Kilo-cycle order to Mega-cycle order, is fastened between the shoulder 26 and the bank 34 of the plug 30 to confine gas flow through the opening 24. The diaphragm 40 has a side 42 opposed to the inlet 16 of the riser 14. Designated by 43 is a seal between the shoulder 28 and the diaphragm 40.

To apply high frequency alternate electric voltage across the diaphragm 40, the side 42 is grounded through the shoulder 28 and there is provided a screw 44 made of an electrically conductive material and screwed into the hole 36, an electric terminal 46 and a compression spring 48 retained between the screw 44 and the terminal 46 to urge the terminal 46 against the opposite side 48 of the diaphragm 40 to establish an electric connection between the screw 44 and the opposite side 48 of the diaphragm 40. The compression spring 48 is made of an electrically conductive material for the purpose of establishing the electric connection. A high frequency electric oscillator 50 capable of 1–2 megacycle is electrically circuited with the screw 44, and a vehicle d.c. battery 52 through an engine ignition switch 54 and a thermostatically controlled switch 56 which is designed to be opened when the engine warms up.

From the foregoing description it will now be understood that when the ignition switch 54 and the thermostatically controlled switch 56 are closed, particularly during cold engine starting and the subsequent engine warming up operation alternate electric voltage is applied across the both sides 42 and 48 of the diaphragm 40 which is made of piezoelectric material and due to piezoelectric effect the diaphragm mechanically vibrates at high frequency. Thus the unvaporized fuel droplets deposited on the side 42 of the diaphragm are subjected to vibration and split into fine particles and easily vaporized.

To prevent breakage of the diaphragm 40 a chamber 58 is defined by the screw 44, the depression 32 and the opposite side 48 of the diaphragm 40 and it communicates with an annular chamber 60 formed in the bottom 22 of the riser 14 around the bank 34 of the plug 30 through the radial passage 38. A damper liquid, which is incompressible, fills the chamber 58 and the radial passage 38, and it occupies lower portion of the annular chamber 60. A pressurized gas fills the remaining portion of the annular chamber 60. A damper chamber constructed and arranged as described will dampen the mechanical vibration of the diaphragm 40 since the damper liquid is permitted out of the chamber 58, thereby to prevent breakage of the diaphragm 40 and to lengthen its operating life.

What is claimed is:

1. An engine intake manifold comprising a riser the bottom wall of which is made of an electrically conductive material which is grounded and has an opening and an enlarged bore aligned with said opening, said opening and said enlarged bore defining therebetween a shoulder facing outwardly from the manifold, said enlarged bore being tapped; a threaded plug made of an electrically insulating material screwed into said enlarged bore, said plug having a depression to define a bank therearound and a hole in the bottom of said recess, said bank having at least one radial passage; a diaphragm made of a piezoelectric material fastened between said shoulder and said bank to confine gas flow through said opening, said diaphragm having a side which is opposed to an inlet of said riser and grounded through said shoulder; means for selectively applying a high frequency electric voltage to the both sides of said diaphragm, said means having a screw screwed into said hole, a terminal, and a spring retained between said screw and said terminal to urge said terminal against the opposite side of said diaphragm to establish an electric connection between said screw and said opposite side of said diaphragm, said screw confining a fluid flow through said hole, and said screw, said depression and said opposite side of said diaphragm defining a chamber, said means also having a high frequency electric oscillator circuited in series with said screw; an annular chamber formed in the bottom wall of said riser around said bank of said plug and fluidly communicating with said chamber through said radial passage; a damper liquid filling said chamber and said radial passage and occupying a portion of said annular chamber; and a pressurized gas filling the remaining portion of said annular chamber.

* * * * *